United States Patent [19]

Chen

[11] 4,425,705

[45] Jan. 17, 1984

[54] RAZOR WITH LEVER OPERATED BLADE COVER

[75] Inventor: Evan N. Chen, Fairfield, Conn.

[73] Assignee: Warner-Lambert Company, Morris Plains, N.J.

[21] Appl. No.: 275,475

[22] Filed: Jun. 19, 1981

[51] Int. Cl.[3] ..... B26B 21/06

[52] U.S. Cl. ..... 30/84; 30/85; 30/79

[58] Field of Search ..... 30/84, 79, 85, 89, 90, 30/58

[56] References Cited

U.S. PATENT DOCUMENTS

| | | | |
|---|---|---|---|
| 1,943,414 | 1/1934 | Behrman | 30/84 X |
| 2,546,406 | 3/1951 | Rauglas | 30/85 X |
| 2,973,575 | 3/1961 | Redden | 30/84 X |
| 3,080,651 | 3/1963 | Cas | 30/85 |
| 4,328,615 | 5/1982 | Bowman et al. | 30/84 X |

*Primary Examiner*—James M. Meister
*Assistant Examiner*—Willmon Fridie, Jr.
*Attorney, Agent, or Firm*—R. S. Strickler

[57] ABSTRACT

A disposable razor having one or more blades or cutting elements with a permanently attached, slidable blade cover including actuating means manually operable to slide the cover from a first position in which the razor is inoperable and the cutting elements are shielded and protected from damage to a second position in which the cutting elements have proper exposure and the razor is operative.

1 Claim, 7 Drawing Figures

RAZOR WITH LEVER OPERATED BLADE COVER

FIELD OF THE INVENTION

The present invention relates to wet razors and relates in particular to razors of the class which are disposable after the blade cutting edge is dulled by use.

Razors of this class are usually molded by plastic material with the blade being the principal metallic piece-part.

The language "wet razor" is intended to designate razors which are used after skin surface to be shaved has been prepared or conditioned for shaving by use of water and soap or other moisturizing preparations.

This definition is in contrast to the term "dry shavng" which usually is accomplished by a conventional electric razor.

The use of the language "blade", "blade cutting edge" or "blade edge" is intended to include one or more blades each having at least a single cutting edge.

A razor device over which the present invention is an improvement is disclosed and described in a co-pending patent application Ser. No. 108,747, filed Dec. 31, 1979, by Bowman et al. entitled "Razor Blade Assembly with Movable Cover Cap".

In the '747 disclosure, the cover is moved to and fro along its track by grasping the cover, preferably at its end walls, and sliding the cover in one direction to expose the cutting edge a proper amount for shaving or in the opposite direction to shield the edge from damage from extraneous sources.

In the razor of the '747 application, operation of the cover is virtually a "two hand" operation. That is, one must grasp the razor by its handle in one hand and manipulate the cover with one's other hand.

The present invention provides cover actuating means which makes it possible to move the cover in "one hand" fashion. That is, the razor is grasped in one hand and the cover actuating means is operable by the digits of the same hand.

Thus it is a primary object and feature of the present invention to provide a razor having a blade cover which functions dually to protect the blade edge when the razor is not in use and sets proper blade exposure during the act of shaving. The cover is moved by a manual actuating means which is manipulated by the same hand which one uses to grasp the razor.

SUMMARY OF THE INVENTION

A representative embodiment of the present invention may comprise a blade having a cutting edge, a blade support rigidly fixed to a handle, a track formed on the support, a cover with a slide overlaying said blade, and manually operable actuating means for sliding the cover relative to the support from a first position in which the blade is protected and the razor inoperative to a second position in which the blade edge is exposed properly and the razor is operative.

DESCRIPTION OF DRAWINGS

Other features and advantages of the present invention will become apparent from an examination of the succeeding specification when read in conjunction with the appended drawings, in which.

DESCRIPTION OF PREFERRED EMBODIMENTS

Figure 1:
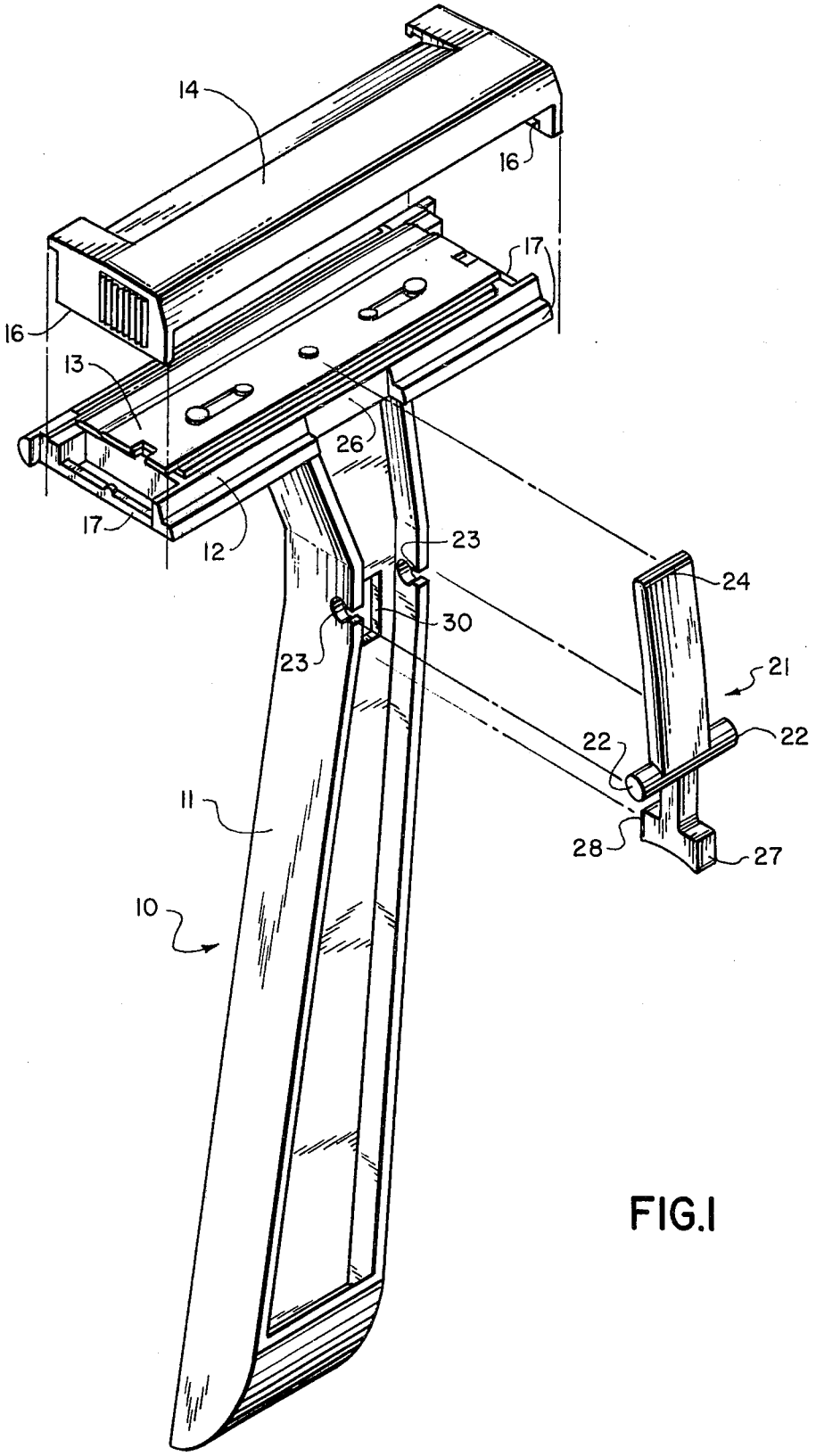
FIG. 1 is a perspective, exploded view of a preferred embodiment of the invention.

Referring now in detail to the drawings, particularly FIGS. 1 through 5, the reference numeral 10 designates a wet razor having a handle 11, blade support 12, blade 13 and blade cover 14.

Figure 2:
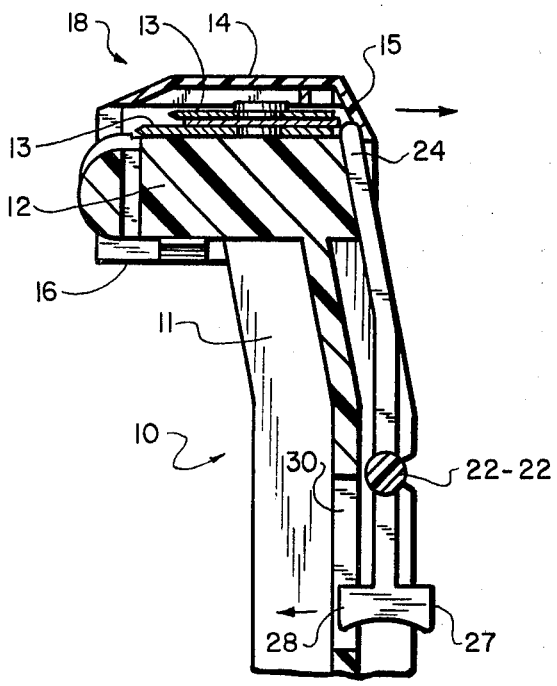
FIG. 2 is a vertical sectional view showing the cover in the first position, i.e., blade covered or protected and the razor inoperative.
Figure 3:
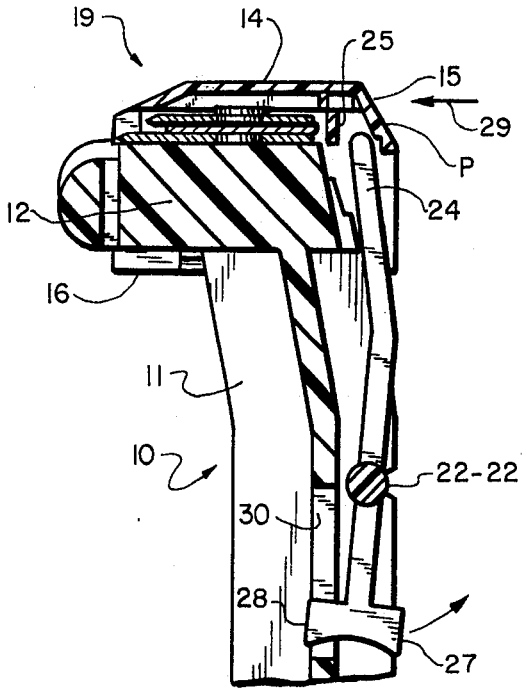
FIG. 3 is similar to FIG. 2 showing the cover in the second position with the blade exposed properly and in condition for operation.
Figure 4:
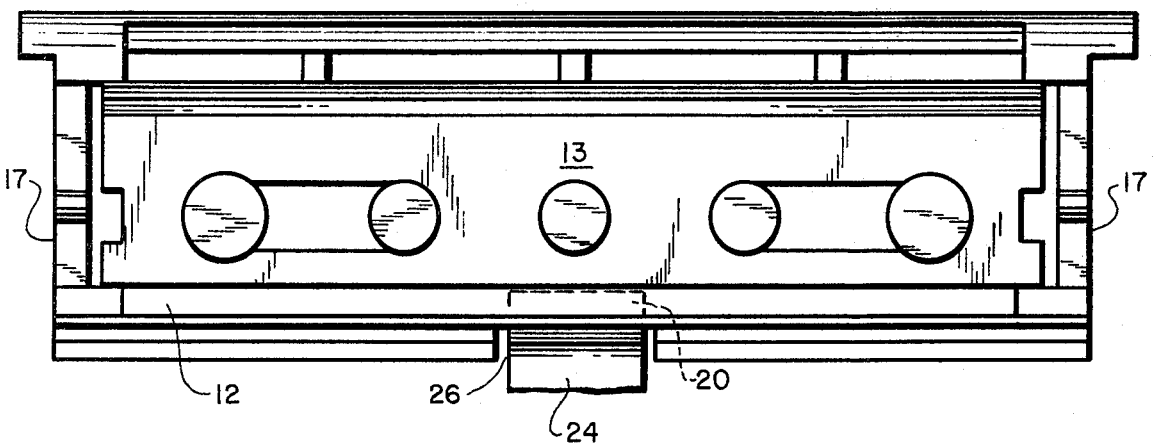
FIG. 4 is a top view of the illustration of FIG. 1 with the cover removed showing the nesting of the upper end of the cover actuating means within the blade support structure.
Figure 5:
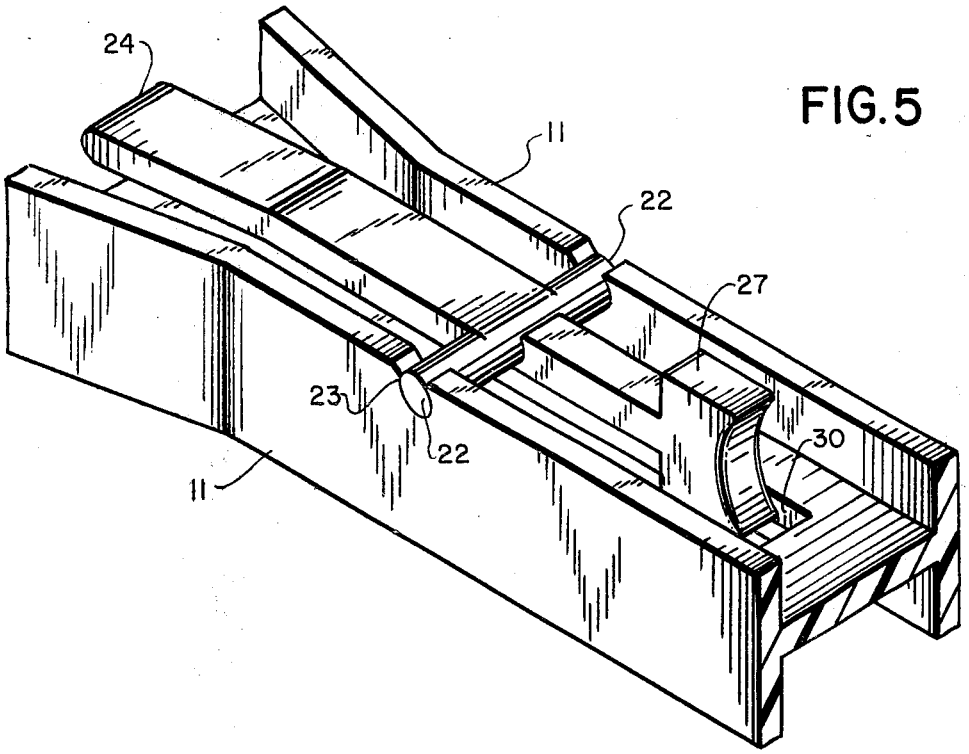
FIG. 5 is an enlarged view of a portion of FIG. 1 showing a preferred cover actuating means.

As disclosed and described in said '747 co-pending application, the cover 14 is formed with a slide 16—16 which engages a track 17—17 on the blade support 12 to guide the cover in sliding relation to the blade, blade support, and handle from a first or closed position indicated generally by the reference numeral 18 in FIG. 2 to a second or operative position indicated generally by the reference numeral 19 in FIG. 3.

A cover actuating means indicated generally by the reference numeral 21 includes a support element defining a pair of opposed stub shafts 22—22 making a "snap fit" into bearings 23—23 formed in handle 11. The actuating means 21 which for purposes of describing and claiming the invention may be labelled, from time to time, as an operating lever includes a driving element or upper end 24 which nests in cut-out 26 formed in blade support 12.

The opposite end of the lever is formed with opposed operating tabs 27, 28 which are manually depressible by digits of the same hand in which a consumer grasps the razor.

As is apparent in FIGS. 2 and 3, depression of the tab 27 in the direction of the lower arrow of FIG. 2 will cause the lever 21 to rotate about handle 11 to cause driving element 24 to bear upon cover skirt 15 to slide cover 14 in the direction of the upper arrow, thus moving the cover 14 from the first or protective position of FIG. 2 to the second or operative position of FIG. 3.

In this embodiment of the invention, the cover can be returned to the first position after use of the razor by merely pushing the cover manually in the direction of the arrow 29 by applying pressure to the cover 14 in the region indicated generally by the letter P in FIG. 3.

However, it is entirely within the scope of the invention to provide tabs 25–250 projecting from the cover 14 (see FIGS. 3 and 7) to facilitate return of the slide to the first position by depression of tab 28 projecting through opening 30. In this arrangement appropriate clearance must be provided in the blade support as indicated in dotted lines labelled 20 in FIG. 4 to accommodate the tabs 25–250 in addition to the "throw" of the lever.

Figure 6:
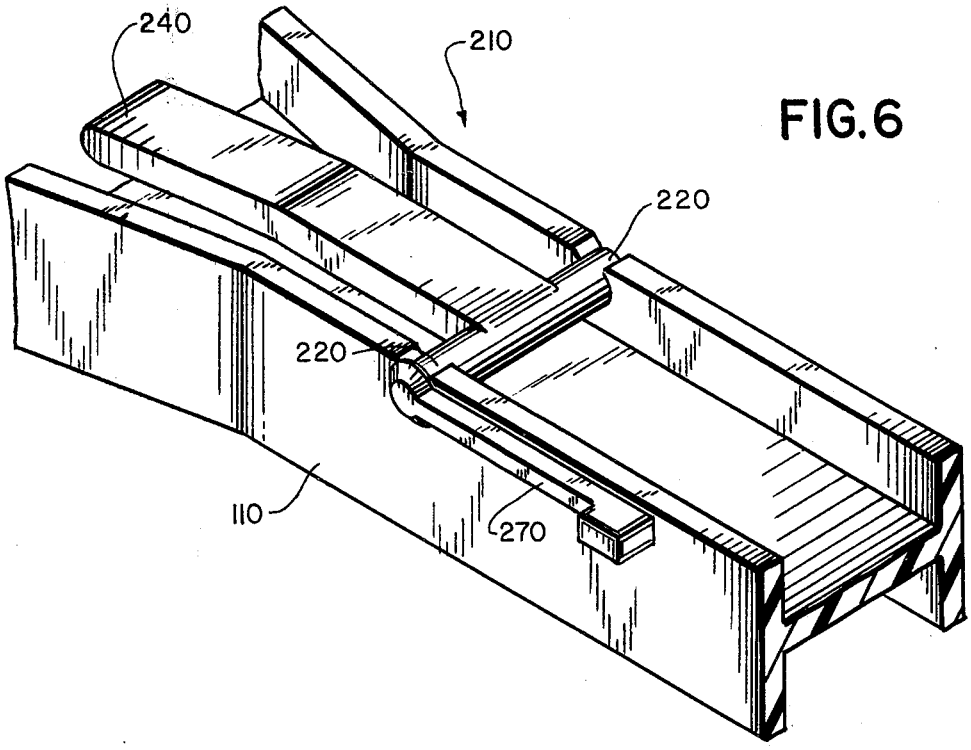
FIG. 6 is similar to FIG. 5 showing an alternative actuating means.
Figure 7:
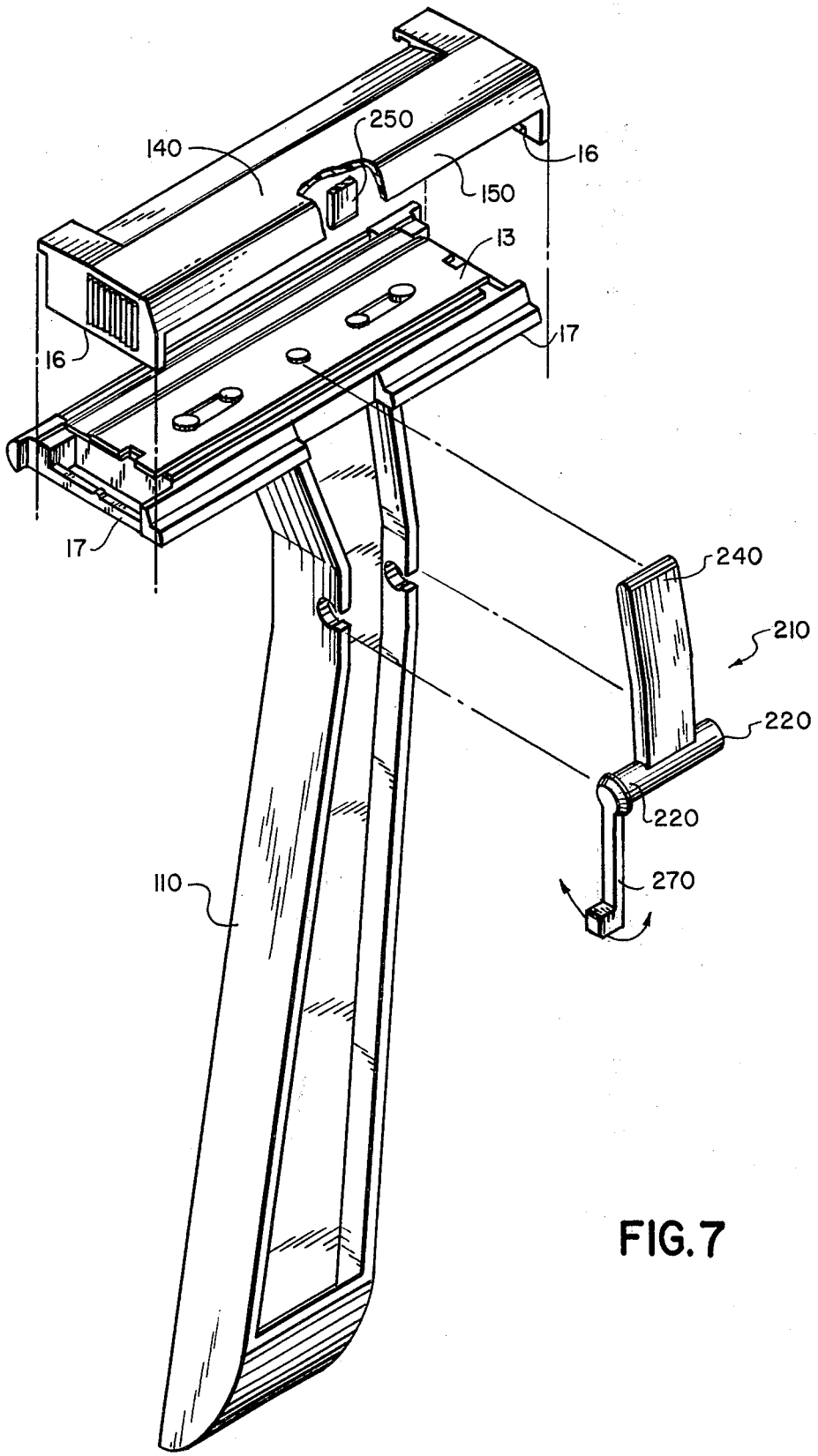
FIG. 7 is a view similar to FIG. 1 showing the relationship of the alternative actuating means to the razor body.

Referring to FIGS. 6 and 7, an actuating means 210 is supported by stub shafts 220—220 in turn making a snap fit into handle 110. In this arrangement, driving element 240 is actuated to move slide 140 by manipulation of crank 270 through an arc represented by the double-ended arrow of FIG. 7.

Rotation of the crank 270 clockwise (FIG. 7) makes a driving connection between element 240 and the inside of cover skirt 150 to move the slide to the second or operative position while rotation of the crank 270 in a counterclockwise direction causes the driving element to contact tab 250 to return the slide to the first or protective position.

It is anticipated that a wide variety of modifications may be devised in the present invention without departing from the spirit and scope thereof.

What is claimed is:

1. In a disposable razor of the type having a single edge blade consolidated and fixed into a molded plastic assembly supported by a handle formed integrally with said plastic assembly, said handle being susceptible of grasping in one-hand fashion, said assembly including a track and a cover with a skirt slidable on said track in a plane parallel to the plane of the blade from a first position in which said blade edge is covered or enclosed to a second position in which the blade edge is exposed for wet shaving, the improvement comprising:

a manually operable actuating means mounted on said handle and cooperating directly with said cover for sliding the cover in said parallel plane from said first position to said second position, said actuating means defining a lever having opposed stub shafts mounted pivotally in said handle, a tab molded integrally with said cover, a first end of said lever on one side of said pivotal mounting being operable to engage directly and make a driving connection with the skirt and the tab, a second end of the lever on the opposite side of the pivotal mounting being operable manually to pivot the lever and thus drive the cover to and fro manipulated by the same hand by which the handle is grasped.

* * * * *